United States Patent [19]

Douglas, III

[11] Patent Number: 4,773,863

[45] Date of Patent: Sep. 27, 1988

[54] AMUSEMENT DEVICE FOR A TOILET BOWL OR URINAL

[76] Inventor: Louis R. Douglas, III, 134A Duboce Ave., San Francisco, Calif. 94103

[21] Appl. No.: 14,953

[22] Filed: Feb. 17, 1987

[51] Int. Cl.[4] ..... A47K 17/00

[52] U.S. Cl. ..... 434/247; 273/86 F; 273/349

[58] Field of Search ..... 434/247; 273/86 F, 349

[56] References Cited

U.S. PATENT DOCUMENTS

| | | | |
|---|---|---|---|
| D. 227,108 | 6/1973 | Halenar | 434/247 |
| 2,699,139 | 1/1955 | Mackey | 434/247 |
| 3,364,478 | 1/1968 | Waard | 434/247 |
| 3,680,151 | 8/1972 | Boardman et al. | 434/247 |
| 3,789,387 | 1/1974 | Hurst | 340/815.31 |

*Primary Examiner*—Leo P. Picard

*Attorney, Agent, or Firm*—Townsend and Townsend

[57] ABSTRACT

An amusement device for a toilet bowl or a urinal comprising a urine detector for detecting a urine flow from a human and for providing an electrical signal for activating a sensory stimulus device. A control unit connected to the urine detector converts the electrical signal to a signal for activating the appropriate indicator. In one embodiment of the invention, a plurality of pressure and temperature sensors are imbedded in a plastic base which is disposed in close proximity to the urinal or toilet bowl drain. Disposed alongside each temperature and pressure sensor is an associated LED lamp or buzzer which is activated by that sensor. The device may be connected to a video screen or a speaker disposed above the urinal for providing additional audial and visual stimulation to the user. In another embodiment, a plastic base is disposed entirely within the toilet bowl or urinal in close proximity to the toilet or urinal drain. A plurality of supports extend upward from the base and terminate in a corresponding plurality of rotatable members horizontally connected to the supports for rotating in response to a urine flow from a human.

35 Claims, 3 Drawing Sheets

AMUSEMENT DEVICE FOR A TOILET BOWL OR URINAL

BACKGROUND OF THE INVENTION

1. Field of the Invention

This invention relates to devices used in conjunction with toilets and urinals and, more particularly, to an amusement device for a toilet bowl or urinal for interactively engaging the attention of a urinating person.

2. Description of the Relevant Art

Maintaining the cleanliness of restrooms is often difficult because of the inadvertent or intentional diversion of urine outside the proper receptacle by people using the restroom. This is particularly so in the case of nightclubs, where frequent use of the restrooms is necessary and the patrons often are too inebriated to care where their urine is directed.

Previous attempts to solve the problem include taking advantage of the fact that people will direct their urine at a target if one is presented to them. For example, U.S. Pat. No. 4,044,405, issued to Joel S. Kreiss, discloses a target disposed within a urinal or toilet to attract the attention of human males. However, such a target is ineffective in nightclubs where the patrons are too inebriated to appreciate such a passive device, and it often fails to sufficiently amuse intentional transgressors.

Another device used for a different purpose is disclosed in U.S. Pat. No. 2,703,407, issued to R.E. Henoch, et al., wherein a rotatable propeller is suspended by struts over a toilet for helping to toilettrain boys. Unfortunately, such a structure is ineffective for the present problem because adults are equally inclined to direct their urine at the support strut along the exterior of the toilet bowl or urinal. Furthermore, the Henoch device discloses a vertically oriented propeller which, if used by adults, particularly males, results in urine being propelled back at the user or otherwise distributed to the exterior of the bowl as a result of centrifugal force and the high volume, high velocity urine stream impinging against the surface of the rotatable member. This further encourages the users to direct their urine stream elsewhere.

SUMMARY OF THE INVENTION

The present invention is directed to an amusement device for a toilet bowl or a urinal wherein a urine detector detects a urine flow from a human and provides an electrical signal for activating a sensory stimulus device such as an audial or visual indicator. A control unit connected to the urine detector converts the electrical signal into a signal for activating the appropriate stimulus device in the appropriate way. The resulting structure is a device which interactively captures the attention of users who are not otherwise fully aware of their actions and provides entertainment to users who would amuse themselves by directing their urine outside of the toilet bowl or urinal.

In one embodiment of the present invention, a plurality of pressure and temperature sensors are imbedded in a plastic base which is disposed in close proximity to the urinal or toilet bowl drain. Disposed alongside each temperature and pressure sensor is an associated LED or buzzer which is activated by that sensor. Accordingly, the combination of sight and sound may be varied by the user upon proper direction of the urine stream, and the user is actively involved in his or her own amusement.

To provide further reinforcement, a speaker or video screen, which is activated by one or more of the temperature or pressure sensors, is disposed above the urinal. The audial or visual signals may originate from the control unit, and the signals may vary depending on the sensor activated.

In another embodiment of the present invention, a plastic base is disposed entirely within the toilet bowl or urinal in close proximity to the toilet or urinal drain. A plurality of supports extend upward from the base and terminate in a corresponding plurality of rotatable members horizontally connected to the support for rotating in response to urine flow from a human. Because each rotatable member is disposed horizontally within the bowl, the urine is confined within the bowl and the risk of splashing urine on either the user or the surroundings is minimized.

DETAILED DESCRIPTION OF THE PREFERRED EMBODIMENTS

Figure 1:
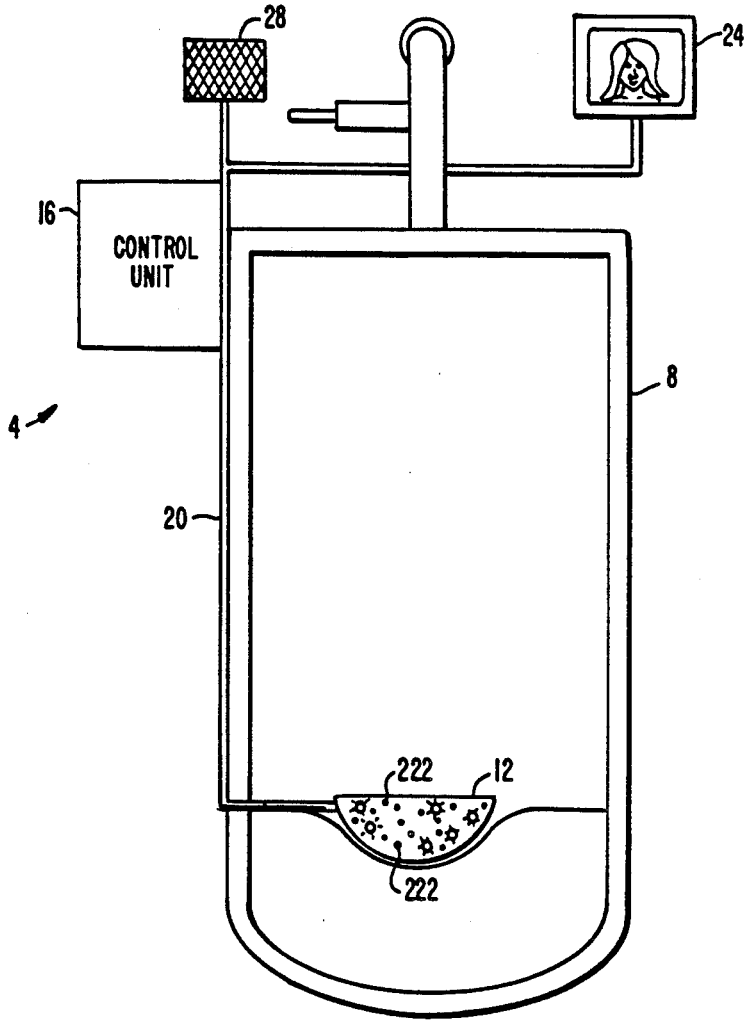
FIG. 1 is a perspective view of an amusement device according to the present invention.

FIG. 1 is an illustration of a preferred embodiment of an amusement device 4 for use with a toilet bowl or urinal 8. Amusement device 4 comprises a urine detector 12 disposed in urinal 8 proximate the urinal drain for detecting a urine flow and for providing in response thereto an electrical signal to a control unit 16 through a cable 20. Control unit 16 in turn activates a sensory stimulus device such as a video screen 24 for providing a visual indication when urine is detected and/or a loudspeaker 28 for providing an audial indication when urine is detected.

Figure 2:
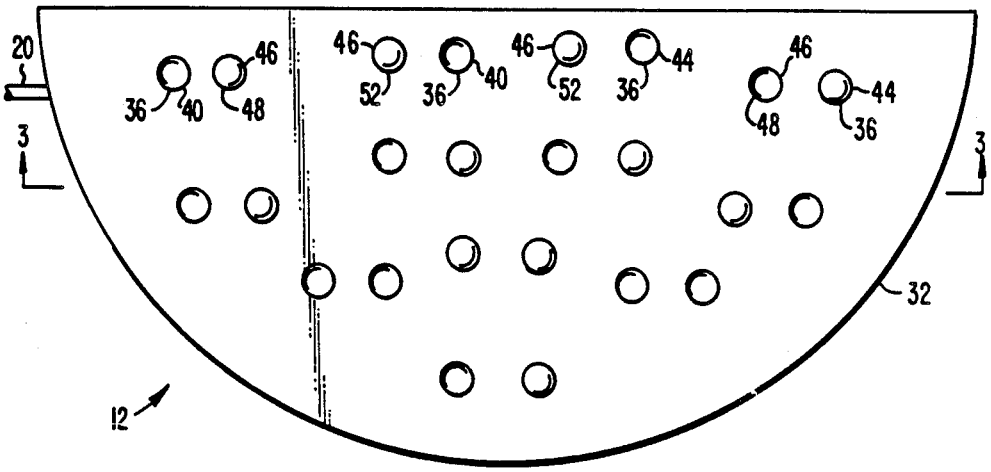
FIG. 2 is a top view of the urine detector shown in FIG. 1.
Figure 3:
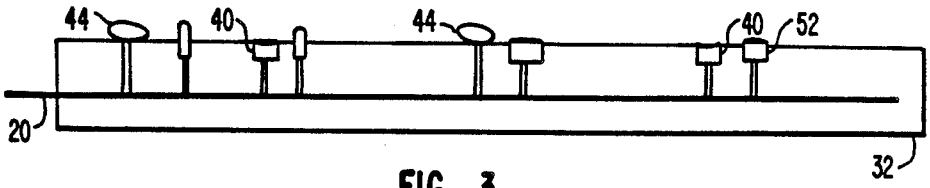
FIG. 3 is a side view taken along line 3—3 of FIG. 2.

As shown in FIGS. 2 and 3, urine detector 12 comprises a base 32 which may be formed from suitable thermoplastic or thermosetting synthetic resins, or from any material which is substantially impervious to urine and will not deteriorate upon contact with urine. Imbedded within base 32 are a plurality of sensors 36 for detecting urine flow from a human. In this embodiment, sensors 36 comprise diaphragm pressure switches 40 and thermistors 44, although any suitable pressure- or temperature-sensitive device may be used. Also disposed on base 32 are a plurality of additional sensory stimulus devices 46 such as LED lamps 48 for providing a visual indication when urine is detected 36 and buzzers 52 for providing an audial indication when urine is detected. In this embodiment, each stimulus device 46 is associated with a single sensor 36, and each stimulus device 46 is disposed in close proximity to the sensor which activates it. Each sensor 36 and stimulus device 46 preferably is covered with a protective film to avoid corrosion or destruction as a result of contact with urine.

Each sensor 36 and stimulus device 46 is imbedded within base 32 and is connected to cable 20 for providing signals to and receiving signals from control unit 16 (FIG. 1). Since the conversion of temperature- and pressure-sensing signals into suitable electrical signals for activating electrical indicators, such as lamps 48 and buzzers 52, are well known, details of construction of control unit 16 shall be omitted. In this embodiment, amusement device 4 is configured so that each sensor 36 activates the stimulus device 46 immediately adjacent to it.

In operation, a sensor 36 detects either the pressure or elevated temperature of a urine flow impinging upon its surface (depending upon the type of sensor used) and provides electrical signals to control unit 16. In response, control unit 16 activates the stimulus device 46 immediately adjacent the activated sensor 36 and optionally generates a sound from loudspeaker 28 or a visual image from video screen 24. The audial and visual responses of indicators 46, loudspeaker 28, and video screen 24 create excitement sufficient to overcome the user's inattentive state and induces the user to express his or her artistic talents by creating an appropriate light show from LED indicators 48 and/or video screen 24, or a symphony through loudspeaker 28 and/or buzzers 52.

Figure 4:
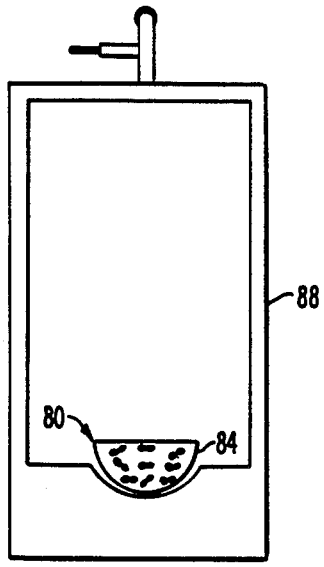
FIG. 4 is a perspective view of a second embodiment of an amusement device according to the present invention.
Figure 5:
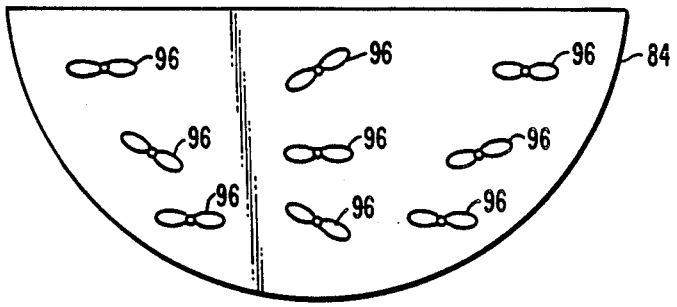
FIG. 5 is a top view of the amusement device shown in FIG. 4.
Figure 6:
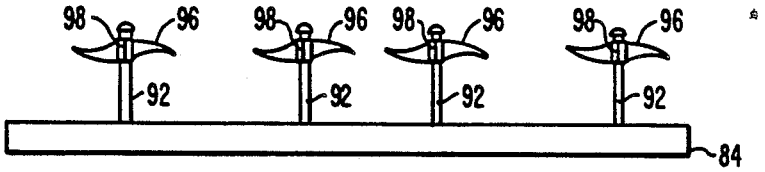
FIG. 6 is a side view taken along line 6—6 of FIG. 4.

If a non-electrical amusement device is desired, the embodiment disclosed in FIGS. 4, 5 and 6 may be used. As disclosed therein, a non-electric amusement device 80 comprises a base 84 disposed within urinal 88 in close proximity to the urinal drain. A plurality of supports 92 extend upward from the base and terminate in a corresponding plurality of rotatable members 96. Rotatable members 96 preferably have a pitched propeller configuration and are fitted freely within recesses 98 of supports 92 so that they may rotate in response to urine flow from a human. To prevent urine from being directed outside the urinal, each rotatable member is disposed generally horizontally on each support.

While the above is a complete description of a preferred embodiment of the present invention, many modifications are obvious to one of ordinary skill in the art. For example, control unit 16 may be connected to a device for stimulating any of the body's senses, including taste, smell and touch. Although a buzzer and an LED lamp are disclosed in connection with base 32, stimulus devices 46 may comprise any suitable visual or audial indicating means, depending on the desired effect. Sensors 36 may comprise any chemical, electrical, or mechanical device for detecting fresh urine, and more than one indicator may be activated by a particular sensor.

Additionally, control unit 16 may be configured so that different musical notes are emitted from loudspeaker 28, or different pixels of video screen 24 are illuminated to produce a starburst effect, depending on the sensor activated. Control unit 16 may also include a timer for maintaining each stimulus device 46 active for a prescribed time after a signal is received by its corresponding sensor 36, and/or it may include a pulsing unit so that each stimulus device 46 is activated intermittently.

Finally, control unit 16 may be omitted in simpler embodiments where a power source, such as a battery, is directly connected to the stimulus devices 46 through appropriate temperature or pressure switches. Consequently, the description should not be used to limit the scope of the invention which is properly described in the claims.

I claim:

1. An amusement device for a toilet bowl or urinal comprising:

a sensor disposed in the toilet bowl or urinal for detecting a flow for urine from a human, the sensor being located in the toilet bowl or urinal so that a urinating human may selectively direct a stream of urine against the sensor for selectively activating the sensor; and electrical signal means, responsive to the sensor, for providing an electrical signal when a flow of urine is detected by the sensor.

2. The device according to claim 1 further comprising stimulating means, responsive to the electrical signal means, for providing a sensory stimulation when urine is detected by the sensor.

3. The device according to claim 2 wherein the stimulating means comprises:

audial indicating means, responsive to the electrical signal means, for providing an audial indication when urine is detected by the urine detecting means.

4. The device according to claim 3 wherein the urine detecting means is a pressure sensor for detecting a prescribed pressure of urine impinging upon a surface thereof.

5. The device according to claim 4 wherein the urine detecting means comprises a base having a plurality of pressure sensors disposed thereon and wherein the electrical signal means provides a unique signal for selected ones of the plurality of pressure sensors.

6. The device according to claim 5 wherein the electrical signal means provides a unique signal for each pressure sensor.

7. The device according to claim 5 further comprising:

a sound emitting means associated with a pressure sensor and connected to the electrical signal means for providing an audial indication when urine is detected by the associated pressure sensor.

8. The device according to claim 7 wherein a sound emitting means is disposed in close proximity to an associated pressure sensor.

9. The device according to claim 5 further comprising a plurality of sound emitting means disposed in close proximity to and associated with one of a plurality of pressure sensors.

10. The device according to claim 9 wherein each sensor has a separate sound emitting means associated therewith for creating an audial stimulus which varies depending on the sensor activated.

11. The device according to claim 2 wherein the stimulating means comprises visual indicating means, responsive to the electrical signal means, for providing a visual indication when urine is detected by the sensor.

12. The device according to claim 11 wherein the sensor is a pressure sensor for detecting a prescribed pressure of urine impinging upon a surface thereof.

13. The device according to claim 12 wherein the urine detecting means comprises a base having a plurality of pressure sensors disposed thereon and wherein the electrical signal means provides a unique signal for selected ones of the plurality of pressure sensors.

14. The device according to claim 13 wherein the electrical signal means provides a unique signal for each pressure sensor.

15. The device according to claim 13 further comprising:

a light emitting means associated with a pressure sensor and connected to the electrical signal means for providing a visual indication when urine is detected by the associated pressure sensor.

16. The device according to claim 15 wherein a light emitting means is disposed in close proximity to an associated pressure sensor.

17. The device according to claim 13 further comprising a plurality of light emitting means, each light emitting means being disposed in close proximity to and associated with one of a corresponding plurality of pressure sensors.

18. The device according to claim 17 wherein each sensor has a separate light emitting means associated therewith for creating a visual stimulus which varies depending on the sensor activated.

19. An amusement device for a toilet bowl or urinal comprising:

urine detecting means, disposed in the toilet bowl or urinal, for detecting a flow of urine from a human, the urine detecting means comprising a temperature sensor for detecting a prescribed temperature of urine impinging upon a surface thereof; and electrical signal means, responsive to the urine detecting means, for providing an electrical signal when a flow of urine is detected by the urine detecting means.

20. The device according to claim 19 further comprising stimulating means, responsive to the electrical signal means, for providing a sensory stimulation when urine is detected by the urine detecting means.

21. The device according to claim 20 wherein the stimulating means comprises visual indicating means for providing a visual indication when urine is detected by the urine detecting means.

22. The device according to claim 21 wherein the urine detecting means comprises a base having a plurality of temperature sensors disposed thereon and wherein the electrical signal means provides a unique signal for selected ones of the plurality of temperature sensors.

23. The device according to claim 22 wherein the electrical signal means provides a unique signal for each temperature sensor.

24. The device according to claim 23 wherein the visual indicating means comprises:

a plurality of light emitting means, each light emitting means being disposed in close proximity to and associated with one of a corresponding plurality of temperature sensors.

25. The device according to claim 24 wherein the temperature sensor is located in the toilet bowl or urinal so that a urinating being may selectively direct a stream of urine against the sensor for selectively activating the sensor.

26. The device according to claim 22 wherein the visual indicating means comprises:

a light emitting means associated with a temperature sensor and responsive to the electrical signal means for providing a visual indication when urine is detected by the associated temperature sensor.

27. The device according to claim 26 wherein a light emitting means is disposed in close proximity to an associated temperature sensor.

28. The device according to claim 20 wherein the stimulating means comprises audial indicating means for providing an audial indication when urine is detected by the urine detecting means.

29. The device according to claim 28 wherein the urine detecting means comprises a base having a plurality of temperature sensors disosed thereon and wherein the electrical signal means provides a unique signal for selected ones of the plurality of temperature sensors.

30. The device according to claim 29 wherein the electrical signal means provides a unique signal for each temperature sensor.

31. The device according to claim 30 wherein the audial indicating means comprises:

a plurality of sound emitting means, each sound emitting means being disposed in close proximity to and associated with one of a corresponding plurality of temperature sensors.

32. The device according to claim 31 wherein the temperature sensor is located in the toilet bowl or urinal so that a urinating being may selectively direct a stream of urine against the sensor for selectively activating the sensor.

33. The device according to claim 29 wherein the audial indicating means comprises:

a sound emitting means associated with a temperature sensor and responsive to the electrical signal means for providng an audial indication when urine is detected by the associated temperature sensor.

34. The device according to claim 29 wherein a sound emitting means is disposed in close proximity to an associated temperature sensor.

35. An amusement device for a toilet bowl or urinal comprising:

a sensor disposed in the toilet bowl or urinal for detecting a flow of urine from a human, the sensor being located in the toilet bowl or urinal so that a urinating human may selectively direct a stream of urine against the sensor; and electrical signal means, responsive to the sensor, for providing a first electrical signal when a urine stream is directed against the sensor and for providing a second, different electric signal when a urine stream is directed away from the sensor.

* * * * *